US010290275B2

(12) United States Patent
Du

(10) Patent No.: US 10,290,275 B2
(45) Date of Patent: May 14, 2019

(54) DRIVING CIRCUIT FOR MULTIPLE GOA UNITS MINIMIZING DISPLAY BORDER WIDTH

(71) Applicant: SHENZHEN CHINA STAR OPTOELECTRONICS TECHNOLOGY CO., LTD., Shenzhen, Guangdong (CN)

(72) Inventor: Peng Du, Guangdong (CN)

(73) Assignee: SHENZHEN CHINA STAR OPTOELECTRONICS TECHNOLOGY CO., LTD., Shenzhen, Guangdong (CN)

( * ) Notice: Subject to any disclaimer, the term of this patent is extended or adjusted under 35 U.S.C. 154(b) by 179 days.

(21) Appl. No.: 15/327,551

(22) PCT Filed: Jan. 13, 2017

(86) PCT No.: PCT/CN2017/071161
§ 371 (c)(1),
(2) Date: Jan. 19, 2017

(87) PCT Pub. No.: WO2018/120308
PCT Pub. Date: Jul. 5, 2018

(65) Prior Publication Data

US 2018/0277051 A1 Sep. 27, 2018

(30) Foreign Application Priority Data

Dec. 29, 2016 (CN) ..... 2016 1 1246748

(51) Int. Cl.
*G09G 3/36* (2006.01)

(52) U.S. Cl.
CPC ... *G09G 3/3677* (2013.01); *G09G 2310/0286* (2013.01); *G09G 2310/06* (2013.01); *G09G 2310/08* (2013.01)

(58) Field of Classification Search
CPC .. G09G 3/3677; G09G 3/3648; G09G 3/3674; G09G 3/3688; G09G 3/3266;
(Continued)

(56) References Cited

U.S. PATENT DOCUMENTS 8,411,074 B2 * 4/2013 Liu ..... G09G 3/20 345/100
2003/0043104 A1 3/2003 Lee et al.
(Continued)

FOREIGN PATENT DOCUMENTS

CN 1407527 A 4/2003
CN 1797155 A 7/2006
(Continued)

*Primary Examiner* — Darlene M Ritchie
(74) *Attorney, Agent, or Firm* — Muncy, Geissler, Olds & Lowe, P.C.

(57) ABSTRACT

The present disclosure proposes a driving circuit. The driving circuit includes a gate-driver on array (GOA) unit at n stages and n scan lines. A scan line is arranged on the GOA unit at every stage. GOA units at any two neighboring stages arranged at both sides of the scan line. The GOA unit near the first clock signal line is connected to the first clock signal line. The GOA unit near the second clock signal line is connected to the second clock signal line. The nth stage GOA unit couples to an (n−1)th stage GOA unit and an (n+1)th stage GOA unit.

3 Claims, 5 Drawing Sheets

(58) Field of Classification Search
CPC ..... G09G 2310/0286; G09G 2310/08; G09G 2310/0283; G09G 2310/0264; G09G 2310/0243; G09G 2310/0251; G09G 2300/0408; G09G 2300/0404; G02F 1/13454
See application file for complete search history.

(56) References Cited

U.S. PATENT DOCUMENTS

2006/0007085 A1* 1/2006 Kim ..... G09G 3/3677 345/87
2006/0145991 A1 7/2006 Jang et al.
2006/0221040 A1 10/2006 Pak et al.
2007/0132700 A1* 6/2007 Cho ..... G09G 3/3677 345/100
2008/0174580 A1 7/2008 Chang et al.
2008/0211760 A1* 9/2008 Baek ..... G09G 3/3677 345/98
2009/0096737 A1* 4/2009 Kim ..... G09G 3/3677 345/98
2011/0002438 A1* 1/2011 Kim ..... G11C 19/28 377/67
2014/0176410 A1* 6/2014 Ma ..... G09G 3/3622 345/92
2015/0221272 A1 8/2015 Xu
2015/0269896 A1 9/2015 Umezaki
2015/0302813 A1* 10/2015 Yu ..... G09G 3/3648 345/204
2016/0275902 A1 9/2016 Xue et al.
2018/0047759 A1* 2/2018 Zhao ..... G02F 1/13

FOREIGN PATENT DOCUMENTS

CN 1841484 A 10/2006
CN 102414735 A 4/2012
CN 103730093 A 4/2014
CN 103943085 A 7/2014
CN 104599657 A 5/2015
CN 104658506 A 5/2015
JP 2000347628 A 12/2000

* cited by examiner

DRIVING CIRCUIT FOR MULTIPLE GOA UNITS MINIMIZING DISPLAY BORDER WIDTH

BACKGROUND

1. Field of the Disclosure

The present disclosure relates to the field of a liquid crystal display (LCD), and more particularly, to a driving circuit.

2. Description of the Related Art

A gate-driver on array (GOA) technique is widely applied in the display industry. The adoption of the GOA technique effective saves the gate integrated circuit (gate IC) and well realizes the border-free structure, which is a key technique for future panel design. In addition, a product with a slim border is one of the latest fashion trends. For the fashion trend of the panel design, to integrate GOA and the slim border is one of the important elements.

Generally, each gate line is driven by a GOA circuit at one stage. The height of a wiring zone of the GOA circuit on the periphery of the panel is the same as the height of a subpixel. For a panel with lower resolution, the layout of the panel can be easily designed because the size of the subpixel is larger and the height of the wiring zone of the GOA circuit on the periphery of the panel is greater. When the resolution of the panel increases, for example, from FHD to UHD, the length and width of the pixel reduces to half the original length and width of the pixel. Moreover, the height of the wiring space of the GOA circuit at every stage on the periphery zone reduces to half the height of the wiring space accordingly. It may enlarge the width of the wiring space for a better layout under such a condition. However, it may broaden the width of the peripheral border, which disfavors the design of the slim border.

Therefore, it is necessary to provide a driving circuit to solve the problems related to the related art.

SUMMARY

A driving circuit is proposed by the present disclosure to reduce the width of a gate-driver on array (GOA) zone.

According to the present disclosure, a driving circuit includes a first clock signal line, a second clock signal line, a gate-driver on array (GOA) unit at n stages, and n scan lines. The first clock signal line and the second clock signal line are arranged opposite. The first clock signal line is configured to input a first clock signal. The second clock signal line is configured to input a second clock signal.

A scan line is correspondingly arranged on the GOA unit at every stage. GOA units at any two neighboring stages arranged at both sides of the scan line; the GOA unit near the first clock signal line is connected to the first clock signal line. The GOA unit near the second clock signal line is connected to the second clock signal line.

The GOA unit comprises an first cascading signal input terminal, an second cascading signal input terminal, and an output terminal.

An first cascading signal input terminal of the nth stage GOA unit is connected to an output terminal of the (n−1)th stage GOA unit.

A second cascading signal input terminal of the nth stage GOA unit connected to an output terminal of the (n+1)th stage GOA unit.

According to the present disclosure, a driving circuit comprises a first clock signal line, a second clock signal line, a gate-driver on array (GOA) unit at n stages, and n scan lines. The first clock signal line and the second clock signal line are arranged opposite.

A scan line is correspondingly arranged on the GOA unit at every stage. GOA units at any two neighboring stages arranged at both sides of the scan line. The GOA unit near the first clock signal line is connected to the first clock signal line. The GOA unit near the second clock signal line is connected to the second clock signal line.

The nth stage GOA unit couples to an (n−1)th stage GOA unit and an (n+1)th stage GOA unit.

According to the present disclosure, a driving circuit comprises a first clock signal line set, a second clock signal line set, GOA unit sets corresponding to n rows, and 2 n scan lines. The first clock signal line set and the second clock signal line set are arranged opposite. Two scan lines are correspondingly arranged on every GOA unit set. The first clock signal line set and the second clock signal line set are arranged opposite. Two scan lines are correspondingly arranged on every GOA unit set.

GOA unit sets at any two neighboring rows arranged at both sides of the scan line. The GOA unit set near the first clock signal line set connected to the first clock signal line set. The GOA unit near the second clock signal line set connected to the second clock signal line set.

A GOA unit set corresponding to an nth row is connected to a GOA unit set corresponding to an (n−1)th row and a GOA unit set corresponding to an (n+1)th row.

According to the present disclosure, GOA units at odd-numbered stages and GOA units at even-stages are arranged at both sides of the panel. Also, a clock signal line is arranged at both sides of the panel. Such arrangements facilitate the width of the GOA zone.

DETAILED DESCRIPTION OF THE PREFERRED EMBODIMENTS

Figure 1:
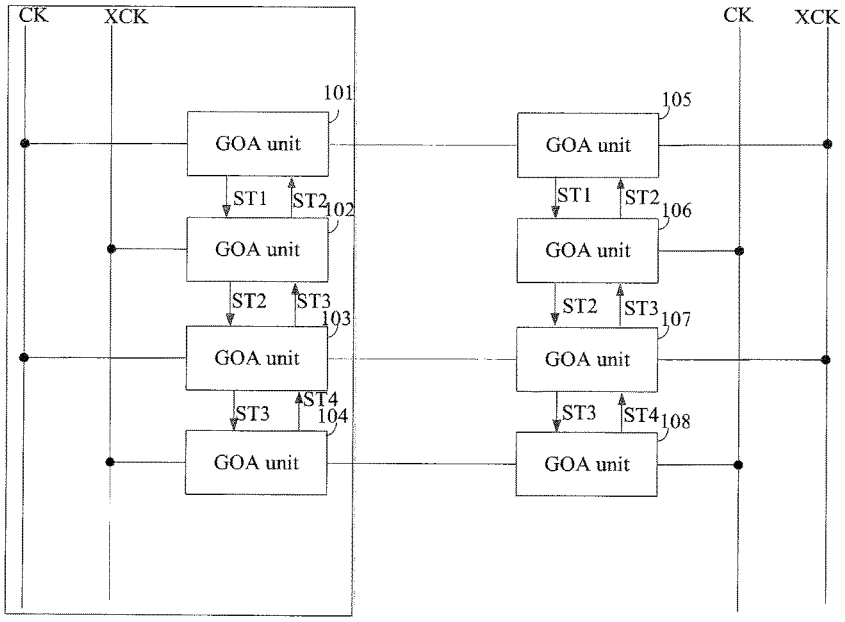
Fig. 1 (Prior art)
FIG. 1 illustrates an equivalent circuit diagram of a conventional driving circuit.

Spatially relative terms, such as "beneath", "below", "lower", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. In the drawings, the components having similar structures are denoted by the same numerals.

Please refer to FIGS. 1 through 4. FIG. 1 shows a schematic diagram of a driving circuit according to the related art.

As illustrated in FIG. 1, the driving circuit which is a GOA circuit includes two clock signal lines for inputting clock signals CK and XCK on a left side and two clock signal lines on a right side for inputting clock signals CK and XCK. Eight GOA units 101-108 are evenly arranged at two sides. Each GOA unit outputs two signals G(n) for controlling a corresponding gate line and ST(n) for enabling the (n+1)th stage GOA circuit. The signal ST(n) is also coupled to a pull-down part of the (n−1)th stage GOA circuit. A start signal ST applied on the first stage GOA circuit is supplied by a dummy stage GOA circuit or a driver integrated circuit (IC).

As illustrated in FIG. 1, the driving circuit which is a GOA circuit includes two clock signal lines for inputting clock signals CK and XCK on a left side and two clock signal lines on a right side for inputting clock signals CK and XCK. Four GOA units 101, 103, 106 and 108 are connected to the clock signal CK, and four GOA units 102, 104, 105 and 107 are connected to the clock signal XCK.

During a forward scanning, a first stage GOA unit 101 on a left side transmits a starting signal ST1 to a second stage GOA unit 102, the second stage GOA unit 102 on the left side transmits a starting signal ST2 to a third stage GOA unit 103, and a third stage GOA unit 103 on a left side transmits a starting signal ST3 to a fourth stage GOA unit 104.

During a backward scanning, a fourth stage GOA unit 104 on the left side transmits a starting signal ST4 to the third stage GOA unit 103, the third stage GOA unit 103 on the left side transmits a starting signal ST3 to the second stage GOA unit 102, the second third stage GOA unit 102 on a left side transmits a starting signal ST2 to the first stage GOA unit 101. The way of the four GOA units on the right side transmitting signal is similar to that of the four GOA units on the left side.

Figure 2:
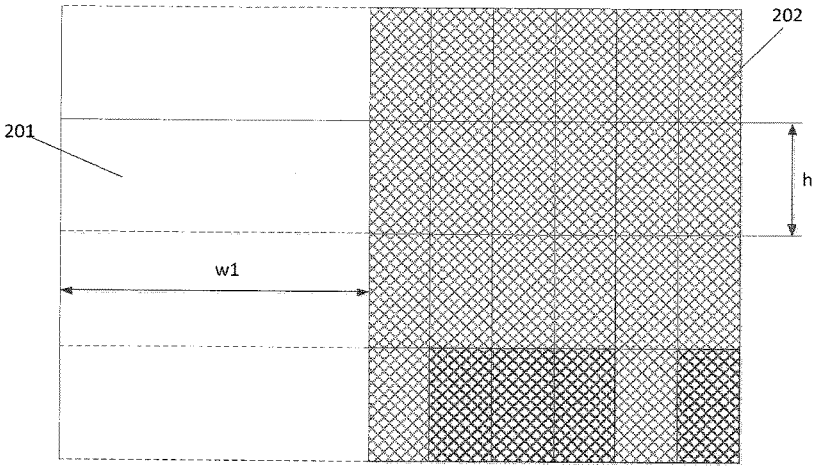
Fig. 2 (Prior art)
FIG. 2 illustrates a driving layout zone of a conventional display panel.

FIG. 2 is a schematic diagram illustrating a GOA wiring zone on the periphery of the panel. A signal in each of the gate lines is generated by the GOA unit at every stage. Correspondingly, the height of the wiring zone 201 of the GOA unit at every stage is the same as the height of the subpixel 202. As h in FIG. 2 shows, the width of the wiring zone 201 of the GOA unit is named w1. The width w1 directly decides the size of the panel border.

Figure 3:
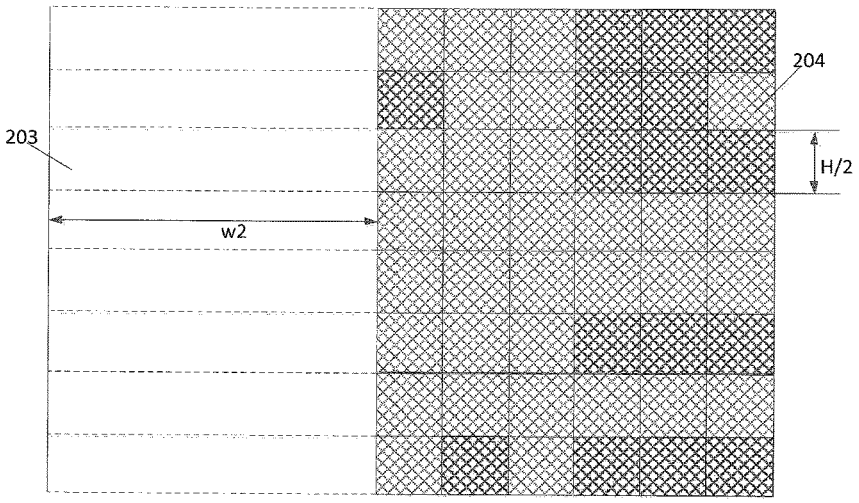
Fig. 3 (Prior art)
FIG. 3 illustrates a driving layout zone of a conventional display panel.

The size of the subpixel correlates with the resolution of the panel. When the resolution of the panel increases, the height of the subpixel decreases. As FIG. 3 shows, when the resolution of the panel increases from FHD to UHD, the height of the subpixel 204 decreases to half the original height, that is, h/2. Correspondingly, the height of a wiring zone 203 on the periphery of the GOA unit decreases to half the original height. The structure of the GOA circuit in panels with different levels of resolution is basically the same so it is necessary to increase the width of the wiring zone when the height of the wiring space decreases so that the components for the GOA unit can be completely put in the wiring zone. The width of the wiring zone is named w2 here. Compared the width of the GOA zone in FIG. 3 with the width of the GOA zone in FIG. 2, the width of the GOA zone of UHD is greater than the width of the GOA zone of FHD, i.e. w2>w1. It implies that the border of the adopted panel with the GOA structure may be broadened once the resolution of the panel increases, which cause the increase in the width of the wiring zone on the periphery of the panel.

Please refer to FIG. 1 again. The width of the GOA wiring zone is formed by two parts, that is, CK signal line and GOA circuit zone, as highlighted by a dotted frame in FIG. 1.

Figure 4:
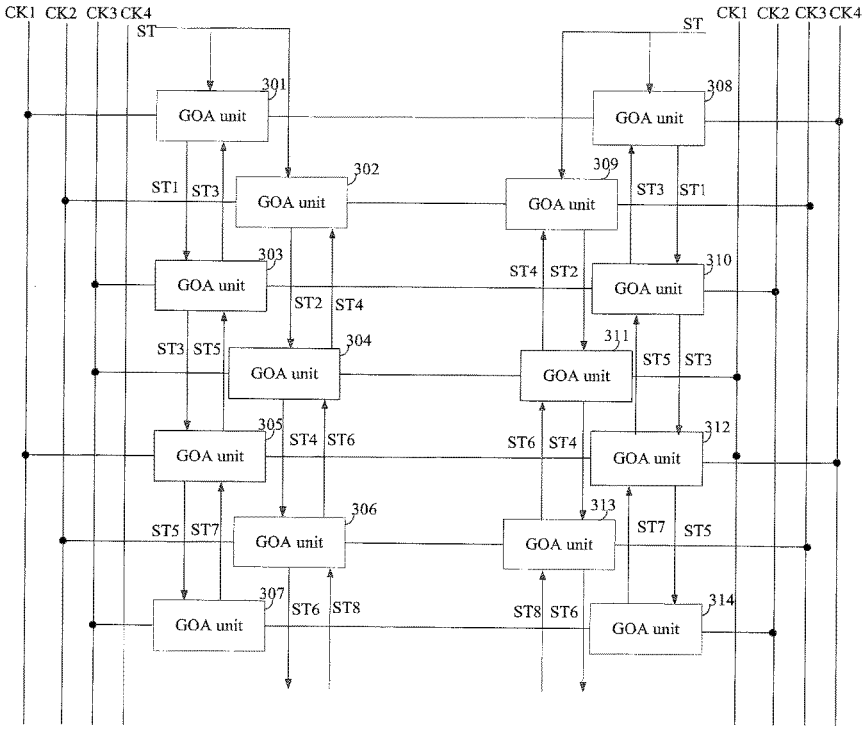
Fig. 4 (Prior art)
FIG. 4 illustrates a schematic diagram of a driving circuit according to a related art.

The panel as shown in FIG. 1 adopts two clock signal lines. A panel with higher resolution usually adopts more CK signals, such as eight or twelve CK signals, to occupy more space of the periphery of the panel. In one embodiment, a panel uses four clock signal lines as shown in FIG. 4. The GOA units at seven stages are arranged on each side of the GOA circuit; the GOA units are 301-314. In the forward scanning, a cascade signal ST1 is input to a third stage GOA unit 303 from the first stage GOA unit 301 at the left. A cascade signal ST2 is input to the fourth stage GOA unit 304 from the second stage GOA unit 302 at the left. A cascade signal ST3 is input to the fifth stage GOA unit 305 from the third stage GOA unit 303 at the left. A cascade signal ST4 is input to the sixth stage GOA unit 306 from the fourth stage GOA unit 304 at the left. A cascade signal ST5 is input to the seventh stage GOA unit 307 from the fifth stage GOA unit 305 at the left.

In the backward scanning, the GOA units at the following stages inputs cascade signals ST7-ST3 to the GOA units at the previous stages, respectively. The cascade method of the GOA units at seven stages at the right side is similar to the cascade method of the GOA units at the left side.

Figure 5:
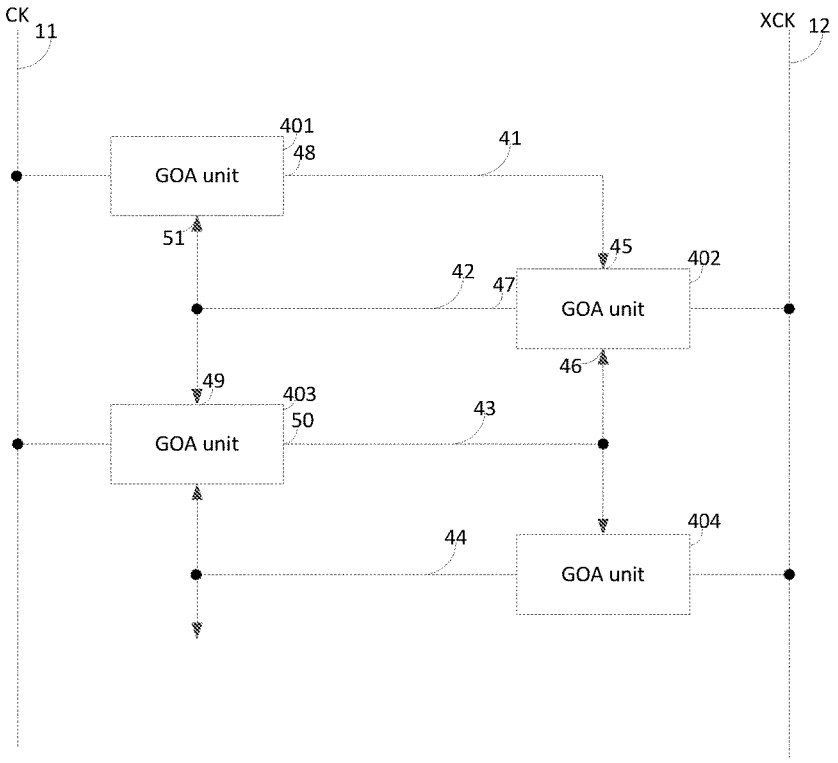
FIG. 5 illustrates a schematic diagram of a driving circuit according an embodiment of the present disclosure.

Please refer to FIG. 5 illustrating the driving circuit according to the embodiment of the present disclosure.

As FIG. 5 shows, the GOA circuit in this embodiment is a GOA circuit. The GOA circuit includes a first clock signal line 11, a second clock signal line 12, GOA units at four stages 401-404, and four scanning lines 41-44. A scanning line is correspondingly arranged on the GOA unit at every stage. The first clock signal line 11 and the second clock signal line 12 are correspondingly arranged. The first clock signal line 11 is used to input a first clock signal CK. The second clock signal line 12 is used to input a second clock signal XCK. The polarity of the first clock signal CK is opposite to the polarity of the second clock signal XCK.

The first stage GOA unit 401 and the second stage GOA unit 402 are arranged at both sides of the scanning lines 41-44. The second stage GOA unit 402 and the third stage GOA unit 403 are also arranged at both sides of the scanning lines 41-44. The third stage GOA unit 403 and the fourth stage GOA unit 404 are arranged at both sides of the scanning lines 41-44. Specifically, the GOA units at odd stages 401 and 403 are arranged at the left side of the scanning line and connected to the first clock signal line 11. Also, the GOA units at even stages 402 and 404 are arranged at the right side of the scanning line and connected to the second clock signal line 12.

Take the second stage GOA unit for example. The second stage GOA unit 402 is connected to the first stage GOA unit 401 and the third stage GOA unit 403.

The GOA unit at every stage includes an input terminal of a first cascading signal, an input terminal of a second cascading signal, and an output terminal. An output terminal of the GOA unit at every stage is connected to a corresponding scanning line. The output terminal is used to output a scanning signal.

An input terminal 45 of the first cascading signal of the second stage GOA unit 402 is connected to an output terminal 48 of the signal of the first stage GOA unit 401. Specifically, the left side of the first scanning line 41 is connected to the output terminal 48 of the signal of the first stage GOA unit 401. And the right side of the first scanning line 41 is connected to the input terminal 45 of the first cascading signal of the second stage GOA unit 402.

An input terminal 46 of a second cascading signal is connected to an output terminal 50 of a third cascading signal.

The output terminal 47 of the signal of the second stage GOA unit is connected to the input terminal 49 of the first cascading signal for the third stage GOA unit and the input terminal 51 of the second cascading signal for the first stage GOA unit 401. The output terminal 47 of the signal of the second stage GOA unit is connected to the second scanning line 42. The input terminal 49 of the first cascading signal for the third stage GOA unit and the input terminal 51 of the second cascading signal for the first stage GOA unit 401 are connected to the second scanning line 42.

The similar condition occurs to the remaining GOA units at other stages.

When n is greater than or equal to four, a (2k+1)th stage (i.e. odd stage) GOA unit is arranged at a first side of the scanning line, and a 2(k+1)th stage (i.e. even stage) GOA unit is arranged at a second side of the scanning line. K is greater than or equal to zero and less than n. The first side is the left side, and the second side is the right side.

In the forward scanning, a signal from the input terminal of the first cascading signal for the first stage GOA unit is supplied by the driver chip.

When n is greater than or equal to four, the input terminal of the first cascading signal for the nth stage GOA unit is connected to the output terminal for the (n−1)th stage GOA unit in the GOA units except for the first stage GOA unit.

The input terminal of the second cascading signal for the nth stage GOA unit is connected to the output terminal for the nth stage GOA unit.

The output terminal for the nth stage GOA unit is connected to the input terminal of the first cascading signal for the (n+1)th stage GOA unit and the input terminal of the second cascading signal for the (n−1)th stage GOA unit.

The output terminal for the nth stage GOA unit is connected to the correspondingly scanning line. The input terminal of the first cascading signal for the (n+1)th stage GOA unit and the input terminal of the second cascading signal for the (n−1)th stage GOA unit are connected to the scanning line which the nth stage GOA unit corresponds to.

The first stage GOA unit 401 is turned on by the ST signal output by the driver chip. A scanning signal G1 output by the driver chip drives the corresponding gate line 41 and is used as a start signal of the of the second stage GOA unit 2k+2 to turns the second stage GOA unit 402 on. The output from the second stage GOA unit 402 has three functions. Firstly, the second gate line 42 is driven. Secondly, the output signal is transmitted to the first stage GOA unit 401. The voltage level of the output terminal which the scanning line of the first stage GOA unit 401 corresponds to and the voltage level of the Q node are pulled down. Thirdly, the output terminal is transmitted to the third stage GOA unit 403. The Q node of the third stage GOA unit 403 is turned on. In other words, the signal output by the output terminal 47 of the signal of the second stage GOA unit is used to not only supply the second scanning line 42 with a scanning signal but also supply the first stage GOA unit 401 with a pull-down signal and the third stage GOA unit 403 with a STV signal.

Only one clock signal line (i.e. CK signal) is arranged on each of the sides of the panel. So the width of the CK signal line here is half the width of the CK signal line in the GOA wiring zone as shown in FIG. 1.

Figure 6:
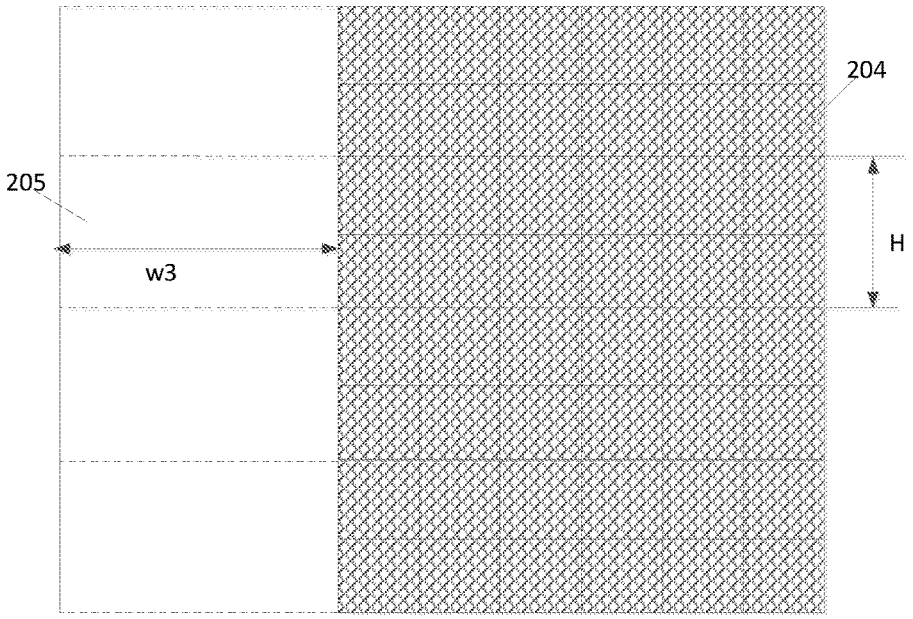
FIG. 6 illustrates a driving layout zone of a display panel according another embodiment of the present disclosure.

In addition, after the structure is adopted, the GOA units arranged at both sides of the panel necessary for two rows of pixels are driven. Therefore, as FIG. 6 shows, the GOA zone 205 at every stage occupies the space for two rows of pixels; that is, the height of the GOA zone 205 increases two times the height of the conventional structure. As FIG. 6 shows, the height of the wiring space of the GOA zone at every stage increases up to h, that is, two times the height of the subpixel pixel 204. Thus, the width of the wiring space of the GOA zone 205 can be replaced by the height when the layout of the GOA is designed so as to reduce the width of the GOA zone. The width of the GOA zone 205 is named w3. The width w3 is less than the width of the GOA zone 203 shown in FIG. 3, i.e. w3<w2, to reduce the size of the panel.

GOA units at odd-numbered stages and GOA units at even-stages are arranged at both sides of the panel. Also, a clock signal line is arranged at both sides of the panel. Such arrangements facilitate the width of the GOA zone.

Figure 7:
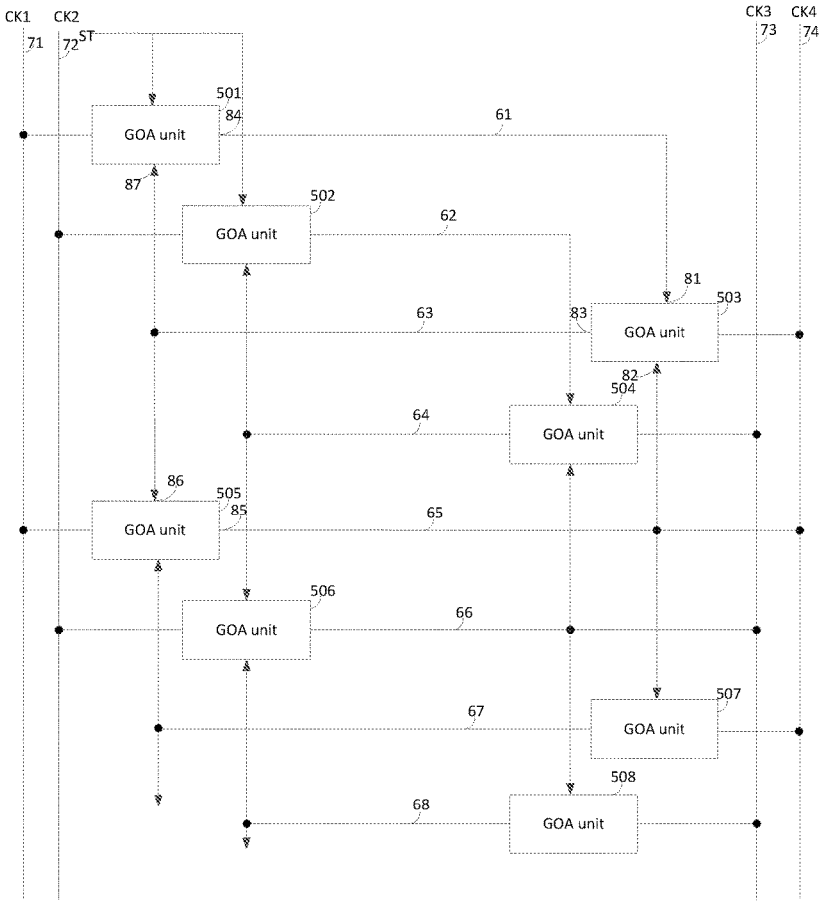
FIG. 7 illustrates a schematic diagram of a driving circuit according yet another embodiment of the present disclosure.

Please refer to FIG. 7 illustrating a schematic diagram of a driving circuit according to a fourth embodiment of the present disclosure.

As illustrated in FIG. 7, the driving circuit which is a GOA circuit includes a first clock signal line set, a second clock signal line set, four GOA unit sets, and eight scan lines 61-68.

The first clock signal line set and the second clock signal line set are arranged at opposite sides. The first clock signal line set includes a first clock signal line 71 and a second clock signal line 72. The second clock signal line set includes a third clock signal line 73 and a fourth clock signal line 74.

The first clock signal line 71 is configured to input a first clock signal CK1. The second clock signal line 72 is configured to input a second clock signal CK2. The third clock signal line 73 is configured to input a third clock signal CK3. The fourth clock signal line 74 is configured to input a fourth clock signal CK4. In another embodiment, the first clock signal CK1 is inverted to the third clock signal CK3, while the second clock signal CK2 is inverted to the fourth clock signal CK4.

The GOA unit set in the first row includes a first stage GOA unit 501 and a second stage GOA unit 502. The GOA unit set in the second row includes a third stage GOA unit 503 and a fourth stage GOA unit 504. The GOA unit set in the third row includes a fifth stage GOA unit 505 and a sixth stage GOA unit 506. The GOA unit set in the fourth row includes a seventh stage GOA unit 507 and an eighth stage GOA unit 508. That is, the GOA unit set corresponding to one row includes two GOA units.

The GOA unit set corresponding to one row connects two scan lines. For example, the first stage GOA unit 501 through the eighth stage GOA unit 508 connect to the scan lines 61-68, respectively. That is, every GOA unit connects to one scan line.

Two adjacent GOA unit sets in two adjacent rows are disposed on two sides of the scan line. For example, the GOA unit sets corresponding to the first row and the third row are disposed on a left side of the scan line and are connected to the first clock signal line set. The GOA unit sets corresponding to the second row and the fourth row are disposed on a right side of the scan line and are connected to the second clock signal line set.

The GOA unit set corresponding to a (2k+1)th row (odd-numbered row) is located at a first side (e.g. left side) of the scan line, while the GOA unit set corresponding to a 2(k+1)th row (even-numbered row) is located on a second side (e.g. right side) of the scan line, where k is greater than or equal to 0, but less than n.

The GOA unit sets corresponding to the (2k+1)th row and the 2(k+1)th row connect to the first clock signal line set and second signal line set, respectively. Each GOA unit of the GOA unit sets corresponding to the (2k+1)th row connects to one of the clock signal line of the first clock signal line set. Each GOA unit of the GOA unit sets corresponding to the 2(k+1)th row connects to one of the clock signal line of the second clock signal line set.

For example, the GOA unit set corresponding to the second row connect to the GOA unit sets corresponding to the first row and the third row.

As shown in FIG. 7, the four GOA unit sets include eight GOA units. Each GOA unit includes a first cascading signal input terminal, a second cascading signal input terminal, and an output terminal.

For example, the GOA unit 503 includes a first cascading signal input terminal 81 coupled to an output terminal 84 of the GOA unit 501, a second cascading signal input terminal 82 coupled to an output terminal 85 of the fifth stage GOA unit 505, and an output terminal 83 coupled to a first cascading signal input terminal 86 of the GOA unit 505 and a second cascading signal input terminal 87 of the GOA unit 501.

The third scan line 63 has one end connected to the output terminal 83 of the GOA unit 503, and the other end connected to the first cascading signal input terminal 86 of the GOA unit 505 and the second cascading signal input terminal 87 of the GOA unit 501.

During forward scanning, a driving chip supplies a start signal ST to the first cascading signal input terminal of the GOA unit 501.

In response to start signal ST from the driving chip, the first stage GOA unit 501 enables to output scanning signal G1 to gate line 61 and to the third stage GOA unit 503 as a start signal. The third stage GOA unit 503 enables in response to the scanning signal G1. The output of the third stage GOA unit 503 can drive the scan line 63, pull down voltages applied on a Q node and output of the first stage GOA 501, and pull up voltages applied on a Q node of the fifth stage GOA 505. That is, the output of the third stage GOA unit 503 is used as scanning signal of the scan line 63, as pull-down signal of the first stage GOA 501, and as start signal STV of the fifth stage GOA 505.

Upon a condition that n is greater than 4, all of the GOA unit sets corresponding to n rows includes 2n GOA units. Each GOA unit includes a first cascading signal input terminal, a second cascading signal input terminal, and an output terminal. The GOA unit set corresponding to an nth row connects the GOA unit sets corresponding to an (n−1)th row and an (n+1)th row.

Except the first stage GOA unit, the nth stage GOA unit includes a first cascading signal input terminal coupled to an output terminal of the (n−2)th stage GOA unit, a second cascading signal input terminal coupled to an output terminal of the (n+2)th stage GOA unit, and an output terminal coupled to a first cascading signal input terminal of the (n+2)th stage GOA unit and a second cascading signal input terminal of the (n−2)th stage GOA unit.

Each GOA connects to a scan line having one end connected to the output terminal of the nth stage GOA unit, and the other end connected to the first cascading signal input terminal of the (n+2)th stage GOA unit and the second cascading signal input terminal of the (n−2)th stage GOA unit.

Each of the first clock signal set and second clock signal set may include three or more clock signal lines. Each of GOA unit sets may include three or more GOA units. Preferably, a number of clock signal is six, eight, or twelve.

According to the present disclosure, four clock signal lines are evenly arranged at two sides of a display panel, and GOA units corresponding to two adjacent rows are arranged at two sides of a scan line. Therefore, a height of a GOA unit is half of the subpixel. Such arrangements facilitate the width of the GOA zone.

GOA units at odd-numbered stages and GOA units at even-stages are arranged at both sides of the panel. Also, a clock signal line is arranged at both sides of the panel. Such arrangements facilitate the width of the GOA zone.

The present disclosure is described in detail in accordance with the above contents with the specific preferred examples. However, this present disclosure is not limited to the specific examples. For the ordinary technical personnel of the technical field of the present disclosure, on the premise of keeping the conception of the present disclosure, the technical personnel can also make simple deductions or replacements, and all of which should be considered to belong to the protection scope of the present disclosure.

What is claimed is:

1. A driving circuit, comprising: a first clock signal line set, a second clock signal line set, a number (N) of GOA unit sets and a number (2N) of scan lines; the first clock signal line set and the second clock signal line set being arranged at opposite sides of the 2N scan lines; two scan lines correspondingly arranged on every GOA unit set;

an nth GOA unit set connected to an (n−1)th GOA unit set and an (n+1)th GOA unit set;

wherein each GOA unit set comprises a first GOA unit and a second GOA unit;

a first GOA unit of the nth GOA unit set is connected to a first GOA unit of the (n−1)th GOA unit set and a first GOA unit of the (n+1)th GOA unit set;

a second GOA unit of the nth GOA unit set is connected to a second GOA unit of the (n−1)th GOA unit set and a second GOA unit of the (n+1)th GOA unit set;

wherein each of the first GOA unit and the second GOA unit comprises a first cascading signal input terminal, a second cascading signal input terminal, and an output terminal;

a first cascading signal input terminal of each of the first GOA unit and the second GOA unit of the nth GOA unit set is connected to an output terminal of a corresponding (n−2)th GOA unit;

a second cascading signal input terminal of the first GOA unit and the second GOA unit of the nth GOA unit set is connected to an output terminal of a corresponding (n+2)th GOA unit;

an output terminal of each of the first GOA unit and the second GOA unit of the nth GOA unit set is connected to the first cascading signal input terminal of the corresponding (n+2)th GOA unit and the second cascading signal input terminal of the corresponding (n−2)th GOA unit; and wherein n and m are less than or equal to N.

2. The driving circuit of claim 1, wherein the output terminal of each of the first GOA unit and the second GOA unit of the nth GOA unit set is connected to one terminal of a scan line which the nth GOA unit set corresponds to; a first cascading signal input terminal of the (n+2)th GOA unit and a second cascading signal input terminal of the (n−2)th GOA unit are connected to the other terminal of the scan line which the nth GOA unit set corresponds to.

3. The driving circuit of claim 1, wherein a (2k+1)th GOA unit is arranged at a first side of the scan line, and a 2(k+1)th GOA unit is arranged at a second side of the scan line, where k is greater than or equal to zero and less than n.

* * * * *